US006353940B1

(12) United States Patent
Lyden

(10) Patent No.: US 6,353,940 B1
(45) Date of Patent: Mar. 12, 2002

(54) UNDERWEAR

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 0 days.

(21) Appl. No.: 09/474,148

(22) Filed: Dec. 29, 1999

(51) Int. Cl.[7] ..... A41B 9/02
(52) U.S. Cl. ..... 2/403; 2/400
(58) Field of Search ..... 2/403, 466, 78.1, 2/78.3, 400, 401, 406; 450/97, 100, 114

(56) References Cited

U.S. PATENT DOCUMENTS

| | | | | |
|---|---|---|---|---|
| 620,435 A | | 2/1899 | Fisher | |
| 763,683 A | * | 6/1904 | Magoris | 450/100 |
| 1,212,805 A | | 1/1917 | Newman | 2/401 X |
| 1,277,839 A | | 9/1918 | Birkenfeld | 2/408 |
| 1,288,673 A | | 12/1918 | Potterf | 2/400 X |
| 1,662,981 A | | 3/1928 | Pazowski | |
| 1,737,882 A | | 12/1929 | Hatch | 2/237 |
| 1,861,383 A | | 5/1932 | Ficcio | |
| 1,998,140 A | | 4/1935 | Loew | 2/403 |
| D98,867 S | | 3/1936 | Lee | D2/716 |
| 2,034,312 A | | 3/1936 | Rubin | 2/228 |
| 2,128,876 A | | 8/1938 | Boysen | 2/237 |
| 2,216,897 A | | 10/1940 | Zoob | D2/712 X |
| 2,232,246 A | | 2/1941 | Klein | 128/159 |
| 2,401,457 A | | 6/1946 | Bryant | 2/406 |
| 2,408,723 A | * | 10/1946 | Arpin et al. | 2/224 |
| 2,411,922 A | | 12/1946 | Keohane | 2/82 |
| 2,419,867 A | * | 4/1947 | Woodman | 2/224 |
| 2,623,210 A | | 12/1952 | Chatfield | 2/41 |
| 2,652,053 A | | 9/1953 | Dann | D2/712 X |
| 2,742,647 A | | 4/1956 | Khalil | 2/236 |
| 2,872,685 A | | 2/1959 | Denbo | 2/224 |
| 2,983,924 A | | 5/1961 | Cohen et al. | 2/67 |
| 3,141,458 A | | 7/1964 | Burbank | 128/159 |
| 3,166,764 A | | 1/1965 | Stedman et al. | 2/224 |
| 3,169,530 A | | 2/1965 | Grishman | 2/407 X |

(List continued on next page.)

| | | | | |
|---|---|---|---|---|
| 5,915,536 A | | 6/1999 | Alberts et al. | 2/227 |
| 6,026,517 A | * | 2/2000 | Kang | 2/403 |
| 6,038,703 A | * | 3/2000 | Chung | 2/403 |
| 6,061,840 A | * | 5/2000 | Alligator | 2/403 |

FOREIGN PATENT DOCUMENTS

| | | | |
|---|---|---|---|
| CH | 664878 | 4/1988 | 2/400 |
| WO | 89/07896 | 9/1989 | 2/403 |

OTHER PUBLICATIONS

Allsop/Sims Vibration.
Calvin Klein Sport Brief Package.
Seaquest Catalogue.
Boxer Style Shorts, #8, p. 539, Sears Spring/Summer 1978 Catalog, GUA 2900 Library.

*Primary Examiner*—John J. Calvert
*Assistant Examiner*—Alissa L. Hoey
(74) *Attorney, Agent, or Firm*—Westman, Champlin & Kelly, P.A.

(57) ABSTRACT

The present invention teaches novel men's underwear that permit the male reproductive organs to be substantially suspended naturally. This is believed to lower the temperatures to which the testes are subjected thereby increasing the rate and quality of spermatogenesis, and to facilitate greater heat dissipation. Further, this characteristic is believed to facilitate optimal thermoregulation. In addition, it is believed to positively influence the operation of sex hormones and anabolic metabolism regarding the process of adaptation and the acquisition of athletic fitness. Further, the present invention teaches novel underwear for men and women which permit relatively unrestricted flexion and extension of the legs, and distention of the abdomen during breathing, and an area of differential elastic and stitching for reducing chafing and enhancing comfort.

21 Claims, 11 Drawing Sheets

U.S. PATENT DOCUMENTS

| | | | | | |
|---|---|---|---|---|---|
| 3,207,155 | A | | 9/1965 | Casey | 128/159 |
| 3,517,666 | A | | 6/1970 | Atlee | 128/159 |
| 3,621,846 | A | * | 11/1971 | Lehman | 128/159 |
| 3,654,634 | A | * | 4/1972 | Torres | 2/224 |
| D233,633 | S | | 11/1974 | Burkard | D2/712 |
| D238,828 | S | | 2/1976 | Reed | D2/738 |
| 3,963,022 | A | * | 6/1976 | Rotello | 128/158 |
| 4,004,297 | A | | 1/1977 | Polack | 2/227 |
| 4,009,495 | A | | 3/1977 | Faust | 2/406 |
| 4,173,976 | A | | 11/1979 | Bloomquist et al. | 128/159 |
| 4,223,408 | A | | 9/1980 | Sullivan | 2/238 |
| 4,261,060 | A | | 4/1981 | Zawacki | 2/227 |
| 4,371,989 | A | | 2/1983 | Polsky | 2/227 |
| D268,454 | S | | 4/1983 | Novo | D2/711 |
| 4,470,156 | A | | 9/1984 | Duerbeck et al. | 2/227 |
| 4,488,317 | A | | 12/1984 | Polsky | 2/227 |
| 4,494,250 | A | | 1/1985 | Sheppard et al. | 2/227 |
| 4,523,337 | A | | 6/1985 | Leibowitz | 2/237 |
| 4,580,297 | A | | 4/1986 | Maejima | 2/22 |
| 4,602,388 | A | | 7/1986 | Underwood et al. | 2/238 |
| 4,619,004 | A | | 10/1986 | Won | 2/227 |
| 4,625,336 | A | | 12/1986 | Derderian | 2/79 |
| 4,669,130 | A | | 6/1987 | Brown | 2/227 |
| 4,670,913 | A | | 6/1987 | Morell et al. | 2/227 |
| 4,702,239 | A | * | 10/1987 | Ichikawa | 128/159 |
| 4,870,958 | A | | 10/1989 | Webster | 128/159 |
| 4,920,769 | A | | 5/1990 | Rickerl | 66/176 |
| 4,972,525 | A | | 11/1990 | Hwang | 2/406 |
| 5,023,957 | A | | 6/1991 | Harvey | 2/409 |
| 5,029,345 | A | | 7/1991 | Angheluta et al. | 2/403 |
| 5,040,245 | A | | 8/1991 | Staley | 2/409 |
| 5,109,546 | A | | 5/1992 | Dicker | 2/70 |
| 5,131,100 | A | | 7/1992 | Atwater et al. | 2/405 |
| 5,144,697 | A | | 9/1992 | Sandbeck | 2/236 |
| 5,152,014 | A | | 10/1992 | Marx et al. | 2/406 |
| 5,157,793 | A | | 10/1992 | Michels | 2/403 |
| 5,237,706 | A | * | 8/1993 | Nalbandian | 2/403 |
| 5,243,974 | A | * | 9/1993 | Allen | 607/108 |
| 5,275,592 | A | * | 1/1994 | Grizzaffi | 604/396 |
| 5,379,462 | A | | 1/1995 | Morgan et al. | 2/403 |
| 5,524,298 | A | * | 6/1996 | Plunkett | 2/403 |
| 5,547,466 | A | * | 8/1996 | McRoberts et al. | 602/70 |
| 5,598,587 | A | | 2/1997 | Wada | 2/403 |
| 5,647,065 | A | * | 7/1997 | Richerson | 2/403 |
| D387,539 | S | | 12/1997 | Wagner | D2/738 |
| 5,822,802 | A | | 10/1998 | Chou | 2/227 |
| D403,487 | S | | 1/1999 | Crupi et al. | D2/712 X |
| 5,870,779 | A | * | 2/1999 | Heron | 2/403 |
| 5,875,495 | A | * | 3/1999 | Thrower | 2/403 |

* cited by examiner

UNDERWEAR

FIELD OF THE INVENTION

The present invention relates to articles of apparel, and in particular, to underwear which are suitable for use by male and female wearers.

BACKGROUND OF THE INVENTION

Men's and women's underwear frequently include an elastic or stretchlastic material which completely encompasses the wearer's waist. However, the presence of such stretchlastic material across the abdomen can restrict breathing and reduce comfort. Further, men's and women's underwear also frequently include elastic or stretchlastic material surrounding the openings for the wearer's legs. When elastic material is affixed by stitching in a much elongated condition to the textile material of which the garment is made in the area about these openings, then bunching of the underwear can cause both chafing and discomfort. In addition, the design and pattern of the textile material commonly used to make a substantial portion of the anterior side of underwear often includes an elastic or stretchlastic material, or a textile material which otherwise exhibits considerable resilience. When donned, such men's underwear will commonly exert force upon the male reproductive organs, that is, the penis and scrotum containing the testes, and elevate and press the male reproductive organs against the pubic area of the torso. Accordingly, such restrictive underwear do not permit the male reproductive organs to be suspended naturally. Men frequently wore boxer shorts prior to the introduction of men's underwear having these characteristics.

It is well known that the degree to which the male scrotum descends or elevates is at least partially dependent upon temperature. Elevating and pressing the scrotum and testes against the pubic area of the torso therefore potentially subjects these organs to higher than normal temperatures. This is now known to induce the so-called "Jockey Shorts Effect," and can cause a decrease in the rate and quality of spermatogenesis, that is, sperm production. Research has been conducted on the "Jockey Shorts Effect," e.g., see the following articles:

A. Zorgniotti, et al., "The Effect of Clothing on Scrotal temperature in Normal Men and Patients with Poor Semen," *Urology*, February, 1982; 19(2):176–178.

J. Mulcahy, "Scrotal Hypothermia and the Infertile Man," *Journal of Urology*, September, 1984; 132(3):469–470.

R. Mieusset, "Association of Scrotal Hyperthermia with Impaired Spermatogenesis in Infertile Men," *Fertility and Sterility*, December, 1987; 48(6):1006–1011.

G. Brindley, "Deep Scrotal Temperature and the Effect on it of Clothing, Air Temperature, Activity, Posture and Paraplegia," *British Journal of Urology*, February, 1982; 54(1):49–50.

Conventional restrictive underwear which elevate and press the male reproductive organs against the pubic area of the torso also decrease heat radiation and dissipation from the body. It is well known that the head, hands, feet, and male reproductive organs are the most vascularized portions of the male body and greatly contribute to heat dissipation.

Further, restrictive underwear which elevate and press the male reproductive organs against the pubic area of the torso are believed to adversely affect thermoregulation. In this regard, see J. Hales and J. Hutchinson, "Metabolic, Respiratory and Vasomotor Responses to Heating the Scrotum of the Ram," *J. Physiology, London*, 1971, pages 353–375, and D. Ingram and K. Legge, "The Influence of Deep Body And Skin Temperatures on Thermoregulatory Responses to Heating of the Scrotum in Pigs," *J. Physiology*, London, 1972, pages 477–487. The physiology of a pig is considered not far distant from man, thus some of the internal organs of pigs are sometimes transplanted into humans. Ingram found that merely exposing the scrotum of a pig to changing temperatures did indeed induce widespread changes in thermoregulation, such as shunting of blood to the skin, something which is known to have dramatic effects in the context of exercise physiology and athletic performance. The effects of various apparel constructions on heat dissipation and thermoregulation in man can be subjectively determined by weartesting, but also objectively measured and recorded with the use of thermometers and infrared thermography equipment.

In addition, restrictive underwear which elevate and press the male reproductive organs against the pubic area of the torso are believed to adversely influence the production and operation of sex hormones and anabolic metabolism with respect to the process of adaptation and acquisition of athletic fitness. Endurance training such as distance running tends to lower testosterone levels, and generally, can suppress anabolic processes and functions within the body. The reasons for this are many, varied, and complex, but the acute cause primarily derives from the biochemistry of exercise as energy stores and electrolytes become depleted and de-hydration takes place. Moreover, demanding exercise is associated with other residual and chronic effects which can influence the operation of the endocrine system, thus shift the balance of the metabolism towards catabolism. For example, see the following articles which relate to this subject:

A. Hackney, et al., "Reproductive Hormonal Profiles of Endurance-Trained and Untrained Males," *Medicine and Science in Sports Exercise*, February, 1988; 20(1):60–65.

J. Arce, "Subclinical Alterations in Hormone and Semen Profile in Athletes," *Fertility and Sterility*, February, 1993; 59(2):398–404.

J. Arce, "Exercise and Male Factor Infertility," *Sports Medicine*, March, 1993; 15(3):146–169.

C. Jensen, et al., "Prospective Study of Hormonal and Semen Profiles in Marathon Runners," *Fertility and Sterility*, December, 1995; 64(6):1189–1196.

A. Bonen, et al., "Pituitary, Ovarian, and Adrenal Hormone Responses to Marathon Running," *International Journal of Sports Medicine*, December, 1987; 8 Supplement 3:161–167.

H. Tanaka, et al., "Persistent Effects of a Marathon Run on the Pituitary-Testicular Axis," *Journal of Endocrinological Investigation*, April, 1986; 9(2):97–101.

M. De Souza, et al., "Gonadal Hormones and Semen Quality in Male Runners. A Volume Threshold Effect of Endurance Training," *International Journal of Sports Medicine*, October, 1994; 15(7): 383–391.

J. Ayers, et al., "Anthropomorphic, Hormonal, and Psychological Correlates of Semen Quality in Endurance-Trained Male Athletes," *Fertility and Sterility*, June, 1985; 43(6): 917–921.

K. Kuoppasalmi, et al., "Plasma Cortisol, Androstenedione, Testosterone and Luteinizing Hormone in Running Exercise of Different Intensities," *Scandanavian Journal of Clinical Laboratory Investigation*, September, 1980; 40(5): 403–409.

A. Urhausen, et al., "Blood Hormones as Markers of Training Stress and Overtraining," *Sports Medicine*, October, 1995; 20(4): 251–276.

Moreover, it can be readily understood that a condition which has the capability of lowering sperm counts or affecting the viability of sperm, such as the "Jockey Shorts Effect," can via biofeedback relationships thereby also influence the body's production of testosterone and larger function of the endocrine system. Accordingly, the so-called "Jockey Shorts Effect" may then not simply be a matter of lower sperm counts or less viable sperm being produced, rather it is believed that such can have a wider impact upon an individual's metabolism. In this regard, it is believed that a tendency exists for the male metabolism to be shifted in the direction of catabolism to greater degree than would otherwise be the case. By continually altering the normal balance and relationship between the anabolic and catabolic processes, individuals might adversely affect both the rate and amount of acquisition, thus the potential improvement in fitness that would result from the conduct of athletic training. Further, alternating the normal balance and relationship between the anabolic and catabolic processes can possibly influence an individual's general health.

It is known that the scrotum and testes will sometimes retract when a man is exposed to cold temperatures or engages in demanding physical exercise. The same phenomenon can also be observed when training horses or other mammals. In this regard, nature will normally take care of itself. Accordingly, several problems can be introduced by restrictive underwear which elevate and press the male reproductive organs against to the pubic area of the torso. For example, even in warm or hot temperature conditions, the male reproductive organs can be held in a retracted position that is normally associated with the experience of cold temperatures. Further, the subsequent build-up of perspiration induced by such underwear can result in excessive local cooling, and this can affect thermoregulation and metabolism. Even hours after exercise, when individuals do not remove their perspiration soaked conventional prior art underwear, the male reproductive organs can remain in a relatively cold and retracted state. This condition can be associated with catabolism, thus delayed recovery from exercise and impaired acquisition.

Conventional prior art underwear for men and women can also restrict flexion and extension of the legs, and distention of the abdomen during breathing. Both of these phenomenon can influence athletic performance in distance running and other activities. The inventor has two decades of experience as an athlete and coach of distance runners including a member of two U.S. Olympic Teams and a British National Champion upon which to base the practical insights and teachings recited herein. Further, conventional prior art underwear which restrict the legs, abdomen, and in the case of male wearers, elevate and press the male reproductive organs against the pubic area of the torso, can be relatively uncomfortable to wear.

There have been several attempts in the men's underwear prior art to accommodate the male reproductive organs, e.g., U.S. Pat. No. 5,598,587 to Wada, U.S. Pat. No. 5,157,793 to Michels, and U.S. Pat. No. 3,517,666 to Atlee, all of these references hereby being incorporated by reference herein. All of the aforementioned references use a rather similar appendage structure, that is, a "chamber" in U.S. Pat. No. 5,598,587, "oval shaped cut-out" in U.S. Pat. No. 5,157,793, or "pouch" in U.S. Pat. No. 3,517,666 on the anterior side of the underwear for accommodating the male reproductive organs. However, men's underwear including an appendage structure, and the like, are relatively more complex and expensive to manufacture than the preferred embodiment of men's underwear taught in the present invention. Further, some prior art men's underwear configurations tend to induce chafing, and can be less functional and comfortable.

The present invention teaches novel underwear for men and women which do not substantially impair flexion or extension of the legs, or distention of the abdomen. Further, the present invention teaches a range of minimum width in the area between the two openings for a wearer's legs, and also an area of differential elastic and stitching near the area of minimum width. In the case of men's underwear, the novel underwear do not elevate and press the male reproductive organs against the pubic area of the torso. Accordingly, the novel men's underwear are believed to less adversely affect heat dissipation, thermoregulation, spermatogenisis, or normal function of the metabolism and endocrine system relative to convention prior art restrictive underwear. Moreover, the present invention teaches novel underwear for men and women which are both comfortable and attractive.

Reference is also made to co-pending utility patent application entitled "Novel Athletic Shorts," another co-pending utility patent entitled "Anatomical and Shock Absorbing Athletic Pants," and three design patent applications entitled, "Article of Apparel Having Non-Stretchlastic Anterior Waist Portion," "Athletic Shorts Inner Liner Having Non-Stretchlastic Anterior Waist Portion," and "Underwear Having Non-Stretchlastic Anterior Waist Portion," filed the same day as the present application, all of these patent application hereby being incorporated by reference herein.

SUMMARY OF THE INVENTION

The present invention teaches novel men's underwear that permit the male reproductive organs to be substantially suspended naturally. This is believed to lower the temperatures to which the testes are subjected thereby increasing the rate and quality of spermatogenesis, and to facilitate greater heat dissipation. Further, this characteristic is believed to facilitate optimal thermoregulation. In addition, the preferred men's underwear of the present invention are believed to positively influence the operation of sex hormones and metabolism. Accordingly, on the anterior side of preferred men's underwear a single piece of textile material can be folded along the middle and stitched at the inferior edges for permitting the male reproductive organs to be substantially suspended naturally. Alternately, but not preferred, men's underwear can include an appendage for containing the male reproductive organs.

Preferred underwear for use by a wearer include an anterior side, posterior side, superior edge, textile material, two openings for accommodating the legs of a wearer, and retention means substantially consisting of a non-stretchlastic material which does not in and of itself place a substantial spring preload upon a wearer. The preferred non-stretchlastic material can consist of belting and be located in the middle of the anterior side of the underwear in the area corresponding to a wearer's abdomen between the opposing anteriormost aspects of the iliac crests of a wearer's hips in order to facilitate distention of the abdomen during breathing.

The underwear can have a substantially horizontal superior edge on the anterior side and the posterior side, or alternately and as preferred, a substantially horizontal superior edge on the posterior side, and inferior retention means and a superior edge forming a V or U shape on the anterior side. In preferred underwear having an anterior side with a V or U shape, the superior edge in the middle of the anterior side is preferrably inferior to the superior edge on the posterior side in the range between one and four inches.

The preferred underwear for men and women can include large openings for permitting relatively unrestricted flexion and extension of the legs. Elastic material can border the two openings for accomodating a wearer's legs. The preferred underwear has a minimum width in the area between the two openings in the range between one and one and three quarters inches. Further, preferred underwear can include an area of differential elastic and stitching near the location of the minimum width. Alternately, but not preferred, the elastic material bordering each of the two openings can cross from left to right and right to left to form a X shape.

The preferred underwear can be made of a single textile material, or a plurality of textile materials. The preferred underwear can include a relatively stretchlastic textile material, or alternately a relatively non-stretchlastic textile material. The underwear can include a porous and breathable textile material. The underwear can include a hydrophobic textile material, a hydrophilic textile material, or a combination thereof.

The preferred underwear can include a first textile material and a second textile material, and the first textile material used on said anterior side can have greater elongation along the vertical axis relative to the horizontal axis, whereas the second textile material used on the posterior side can have greater elongation along the horizontal axis relative to the vertical axis. Alternately, a preferred underwear can include a textile material having different elongation characteristics in two directions, and the textile material can be orientated as to exhibit greater elongation along the vertical axis relative to the horizontal axis on the anterior side, and the textile material can be orientated as to exhibit greater elongation along the horizontal axis relative to the vertical axis on the posterior side.

DETAILED DESCRIPTION OF THE ILLUSTRATIVE EMBODIMENTS

The present invention teaches novel preferred underwear which permit the male reproductive organs to be substantially suspended naturally, that is, the preferred underwear do not substantially elevate or press the male reproductive organs against the torso near the area of the pubic synthesis. This is believed to lower the temperatures to which the testes are subjected thereby increasing the rate and quality of spermatogenesis, and to facilitate greater heat dissipation. Further, this characteristic is believed to facilitate optimal thermoregulation within the body. In addition, it is believed to positively influence the operation of sex hormones and anabolic metabolism with respect to the process of adaptation and the acquisition of athletic fitness. The novel preferred underwear also facilitate relatively unrestricted flexion and extension of the legs, and distention of the abdomen during breathing. The novel preferred underwear also have a preferred range of minimum width as between the two openings for accommodation a wearer's legs, and can include an area of differential elastic and stitching near the area of minimum width.

Figure 1:
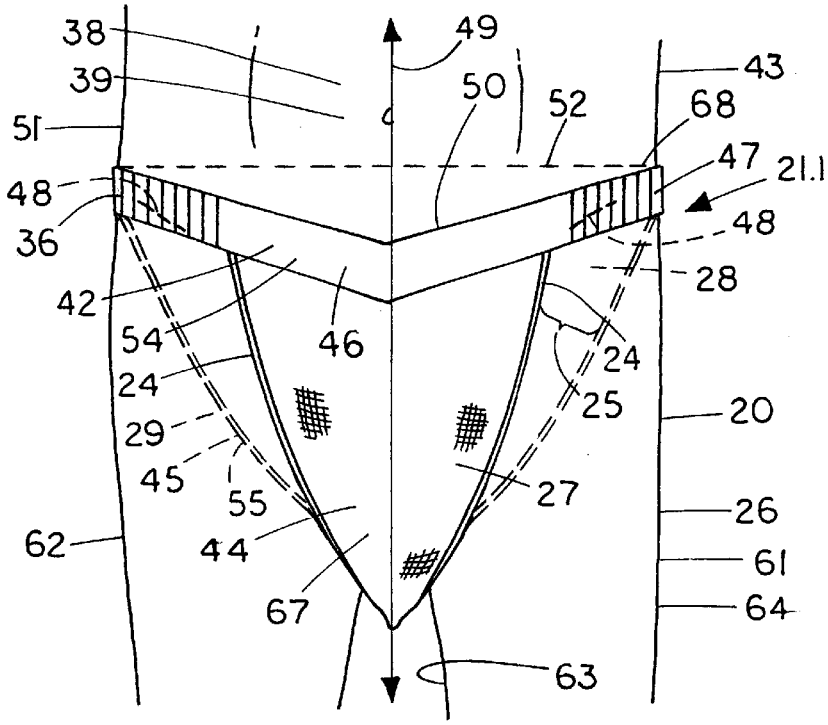
FIG. 1 is an anterior view of the underwear of the invention having a V shape, and a male wearer.
Figure 2:
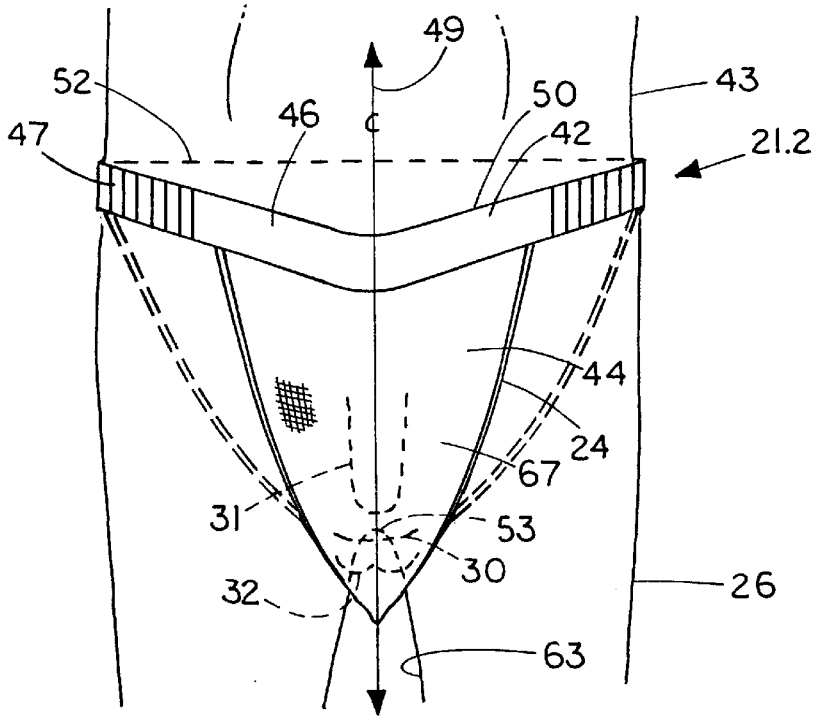
FIG. 2 is an anterior view of an alternate embodiment of the underwear of the invention having a U shape, and a male wearer.
Figure 3:
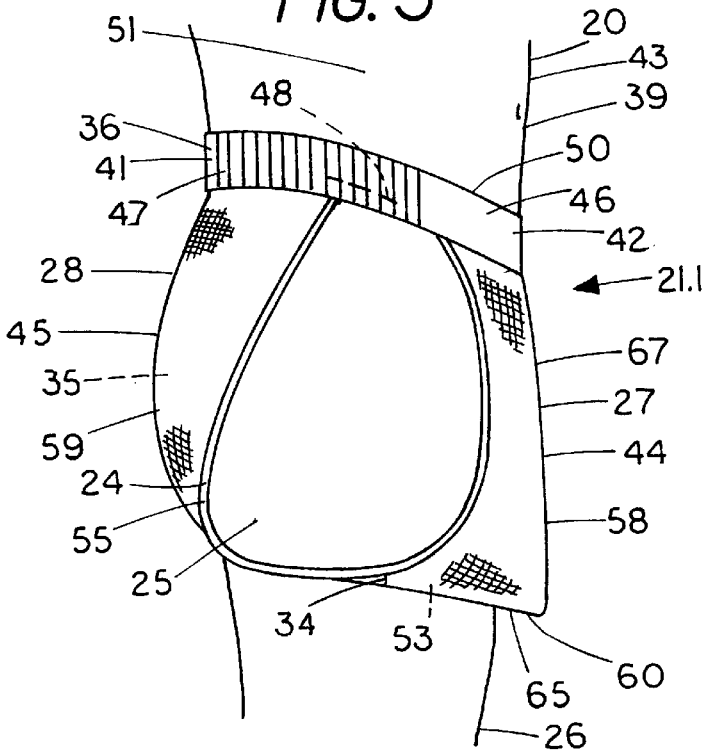
FIG. 3 is a side view of the underwear of the invention shown in FIG. 1 having a V shape, and a male wearer.

FIG. 1 shows the exterior of the anterior side 44 of a pair of preferred underwear 21.1 shown in position on a male wearer 20. Also shown is line 3—3 indicating a cross-sectional view taken along the middle 49 of the torso 43, and a dashed line indicating the normal position of a hypothetical conventional horizontal waistline 52. As shown in FIGS. 1 and 3, a male wearer 20 has donned a pair of preferred underwear 21.1 having a superior edge 50 forming a V shape and having retention means 36 consisting of inferior retention means 42 on the anterior side 44. An alternate preferred underwear 21.2 having a superior edge 50 forming an U shape and having inferior retention means 42 on the anterior side 44 is shown in FIG. 2. As shown in FIG. 1, the approximate location of the inferior edge of the posterior portion 28 of the underwear 21.1 is shown by phantom line 29. As shown, the inferior retention means 42 is substantially continuous on the anterior side 44 of underwear 21.1, that is, inferior retention means 42 is not interrupted by closure means such clasp, button, or zipper. As shown in FIG. 1, preferred underwear 21.1 do not have a fly front, but such is anticipated and can be included, as desired.

The underwear 21.1 can be retained about the individual's abdomen 39 by retention means 36, such as string draw, elastic, button and hole, or other mechanical means, whether in partial or complete combination. However, in order to promote unrestricted breathing, it can be advantageous to use retention means 36 including a substantially non-stretchlastic material 46 on the anterior side 44 of the underwear 21.1, e.g., a material such as belting 54, and the like, which does not in and of itself place a spring preload upon the abdomen 39, and in particular, in the area of the rectus abdominus muscle 38 located between the opposing anterior aspect(s) of a wearer's iliac crest(s) 48. Accordingly, it can be advantageous to terminate the use of conventional waistband consisting of stretchlastic material 47, and the like, within a short distance of the approximate anterior position of a wearer's iliac crests 48 on each side of the abdomen 39, as shown in FIG. 1. It can be advantageous to use a conventional waistband made of stretchlastic material 47 having a width of at least three quarters of an inch, and a width of approximately one and one quarter inch is preferred for use in many applications of underwear 21.1.

The underwear 21.1 can substantially consist of a resilient or stretchlastic material, or alternately, a relatively non-stretchlastic material including natural fibers such as cotton, flax, silk, synthetic fibers such as polyester, polypropylene, nylon, or various blends of natural and synthetic fibers such as cotton and polyester. A preferred textile material 67 for use in the underwear 21.1 substantially consists of cotton. LYCRA® brand spandex, or various COOLMAX® textiles made or licensed by E.I. Dupont de Nemours Company can be used, and the like. Further, various textiles made by Milliken Research Corporation of Spartanburg, N.C., Burlington Industries, Inc. of Hurt, Va., or Darlington Fabrics Corporation of New York can be used, and the like. A stretchlastic material can consist of two-way, three-way or any other type of stretchlastic material. It can be advantageous to use a resilient or stretchlastic material having greater vertical than horizontal elongation on the anterior side 44 of the underwear 21.1 as this configuration can help to restrain anterior and side to side movement of the male reproductive organs while not elevating or pressing the male reproductive organs against the torso 43 near the area of the pubic synthesis 53. Further, it can be advantageous to use a resilient or stretchlastic material having greater horizontal than vertical elongation on the posterior side 45 of the underwear 21.1 as this can enhance fit with respect to a wearer's buttocks. Alternately, the underwear 21.1 can partially or substantially consist of a relatively non-stretchlastic material made of cotton, and the like. It can be readily understood that different textile materials 67 made of a particular material, such as cotton, can exhibit a wide range of elongation properties and be stretchlastic or non-stretchlastic, depending upon the type and size of the fibers, and also the type and size of the knit or weave. Again, the pattern of the underwear 21.1 and the textile material(s) used should be suitable for permitting the male reproductive organs to be substantially suspended naturally.

The underwear 21.1 can be formed of a material which is relatively porous, non-heat retaining, and breathable, or alternately, a material which is relatively non-porous and heat retaining depending upon the anticipated environmental conditions for which the underwear 21.1 are made. The former construction would be suitable for use in the summer months and hotter weather, and the latter would be suitable for use in winter months and cold weather in which a penetrating wind chill could be encountered. Select hydrophilic and or hydrophobic materials, as well as materials having select thermal properties can be used in various configurations and combinations to make the preferred underwear.

The underwear 21.1 can also include a natural or synthetic rubber elastic material 24 bordering the edge 55 of openings 25 for accommodating the wearer's legs 26. The preferred elastic material 24 is between approximately ⅛ and ⅜ths inches in width and in a medium sized pair of underwear measures approximately 25 inches in length about each leg opening prior to elongation. Alternately, the underwear need not include elastic material 24 bordering the edge 55 of openings 25 for accommodating the wearer's legs 26 depending upon inherent elongation and stretchlastic properties of the textile material used to make the underwear. It can be advantageous for the elastic material 24 to be configured, e.g., as shown in FIGS. 1–6, in order to avoid chafing against the inner or medial sides 63 of a wearer's 20 legs 26. The direction of pull of the stretchlastic material and/or elastic material 24 will then not cause the underwear 21.1 to be biased against or rub upon the inner or medial sides 63 of a wearer's 20 legs 26. Configurations that include more restrictive openings 25 for a wearer's 20 legs 26 which are encompassed by elastic material 24 at the edges 55 can result in chafing.

Conventional prior art underwear can elevate and press the male reproductive organs against the torso 43 near the area of the pubic synthesis 53, as shown by phantom line 30 in FIG. 2. However, the present invention teaches, e.g., underwear 21.1-2 which provide ample space to accommodate the natural elevation and descent of the male reproductive organs, and in particular, the scrotum 32 containing the testes. Accordingly, in the present invention the male reproductive organs are not substantially elevated or pressed against the torso 43 near the area of the pubic synthesis 53.

Figure 9A:
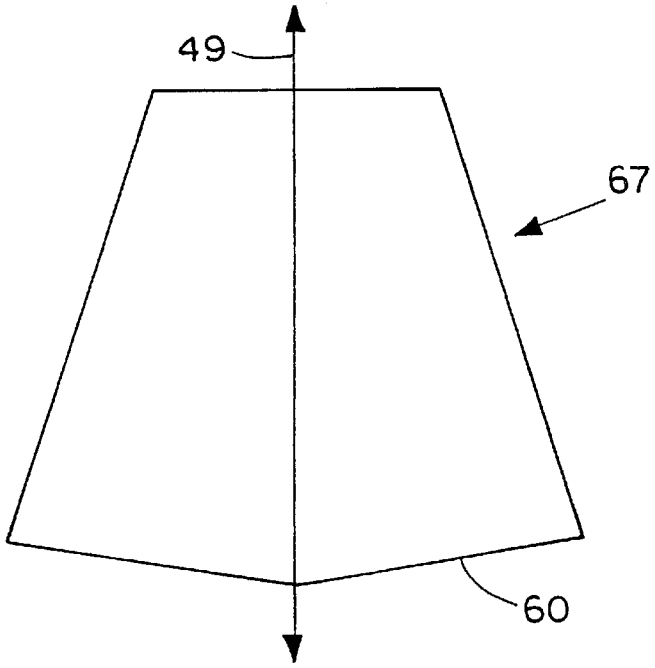
FIG. 9*a* is an anterior view of a piece of textile for making a portion of the anterior side the underwear of the invention for a male wearer.
Figure 9B:
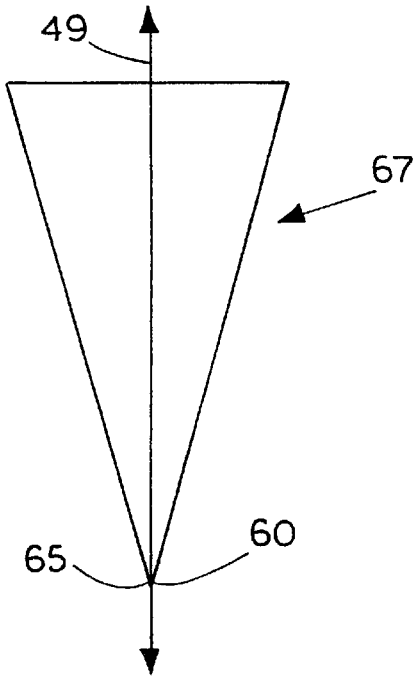
FIG. 9*b* is an anterior view of the piece of textile shown in FIG. 9*a*, but folded and sewn at the inferior edge(s) to make a portion of the anterior side of the underwear of the invention for a male wearer.

The anterior side 44 of a preferred embodiment of men's underwear 21.1 can substantially be made from a single piece of textile material 67 that is folded along the middle and affixed, e.g., by sewing stitches or stitching 65, at the inferior edges 60, as illustrated in FIGS. 9*a*, and 9*b*. However, it can be readily understood that a multiplicity of different patterns and textile materials can be used to construct the present invention. Accordingly, for the purpose of possibly assisting in determining the scope of the present invention in anticipation of possible future litigation, the test method of inserting a ball or sphere having a given diameter into position within a preferred pair of men's underwear 21.1 can be used. For reference, a tennis ball has a diameter of approximately 2.5 inches, a baseball 3.0 inches, and a softball 3.5 inches. However, it can be advantageous to use a hollow plastic ball or sphere when measuring the volume and amount of anatomical accommodation provided by underwear 21.1. According to the teachings of the present invention, and as a minimum with respect to small, medium, large, or extra-large sizes of adult men's underwear 21.1, an inserted ball or sphere having a diameter of 2.5 inches should not be restrained such that it is elevated and pressed against the torso 43 near the area of the pubic synthesis 53, that is, there should be some visible and measurable clearance between the ball and the torso 43 when the ball is inserted within the underwear 21.1. Convention prior art underwear which elevate and press the male reproductive organs against the torso in the area of the pubic synthesis do not pass this test. A test using a 2.5 inch diameter sphere is preferably used with respect to small sized men's underwear. With respect to medium sized men's underwear, the underwear is preferably configured such that an inserted sphere having a diameter of 3.0 inches will pass this test. With respect to large or extra large men's boxer shorts, briefs, or underwear, the underwear is preferably configured such that an inserted ball or sphere having a diameter of 3.5 inches will pass this test. This test method is preferably conducted with the use of a suitable life size male model or mannequin which does not include representation of the male reproductive organs.

Shown in FIG. 2 is a front or anterior view of alternate preferred underwear 21.2 in position on a wearer 20, and including inferior retention means 42 and a superior edge 50 on anterior side 44 forming a U shaped configuration. Also shown is a line indicating the middle 49 of the wearer's 20 torso 43, and a dashed line indicating the normal position of a hypothetical conventional horizontal waistline 52. It can be readily understood that preferred underwear having a superior edge 50 forming a U or V shape, and inferior retention means 42 on the anterior side 44 can be advantageous for use by female as well as male users. The configuration of underwear 21.2 shown in FIG. 2 is advantageous in biasing elastic material 24 and/or the non-stretchlastic or stretchlastic material of which the underwear 21.2 is made away from contact with the inner or medial side 63 of a wearer's 20 legs 26, thus avoiding chafing.

Figure 4:
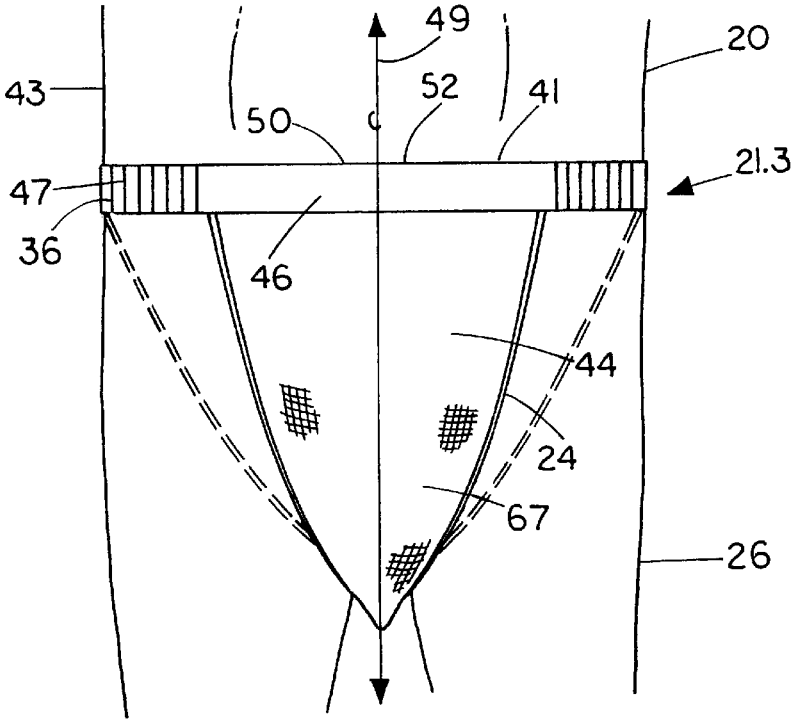
FIG. 4 is an anterior view of an alternate embodiment of the underwear of the invention having a horizontal waistline, and a male wearer.
Figure 5:
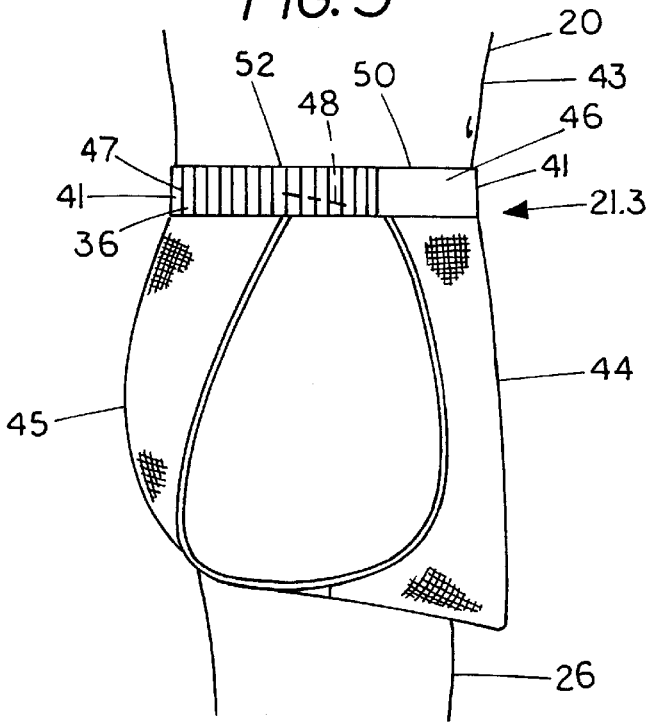
FIG. 5 is a side view of the underwear of the invention shown in FIG. 4 having a horizontal waistline, and a male wearer.

Unlike the alternate preferred embodiment of underwear 21.3 shown in FIGS. 4–5, the preferred athletic shorts 21.1-2 shown in FIGS. 1–3, do not include superior retention means 41 on the front or anterior 44 side, that is, retention means 36 which extend substantially directly across the abdomen 39 in the manner of a conventional horizontal waistline 52. Instead, inferior retention means 42 are used on the front or anterior 44 side of the underwear 21.1-2, that is, when viewed from the front or anterior 44 side, the left and right portions of the superior edge 50 and the retention means 36 of underwear 21.1-2 descend from areas proximate the opposing iliac crests 48 of the hips and the waist 68 of the wearer 20 at downward angles towards the middle 49 of the torso 43 and extends across the lower portion of the abdomen 39 so as to create an arcuate or U, or a V shaped configuration. In a medium size men's underwear, it can be advantageous that the superior edge 50 at the middle 49 of athletic shorts having a U or V shaped configuration on the anterior side 44 be in the range between 1–4 inches inferior to that of conventional horizontal waistline 52, and preferably in the range between 2–3 inches. Relative to superior retention means 41, inferior retention means 42 better accommodates the anatomical structure of the lower portion of the rectus abdominis muscle 38 and distention of a wearer's 20 abdomen 39 during respiration. In FIG. 1, it can be readily understood that the line which indicates the middle 49 of the torso 43 is generally consistent with the vertical or z axis, and that the dashed line indicating the hypothetical position of a conventional horizontal waistline 52 is generally consistent with the horizontal or y axis.

FIG. 3 is a side view of the preferred men's underwear 21.1 shown in FIG. 1, with the wearer's 20 right leg 26 broken away. The underwear 21.1 can comprise a single textile material 67, or a plurality of different materials. Phantom line 34 shows one possible line of delimitation as between two different textile materials 67, that is a first textile material 58, and a second textile material 59 used in the fabrication of underwear 21.1. The front or anterior 44 side of the underwear 21.1, anterior of phantom line 34, can include a first textile material 58 which is a relatively less stretchlastic or non-stretchlastic material, and the back or posterior 45 side of the underwear 21.1 can include a second textile material 59 which is a relatively stretchlastic material. Alternately, a single textile material 67 having greater relative elongation when stretched in one direction than another can be used in different orientations on the front or anterior side 44 versus the back or posterior side 45 of the underwear 21.1. Again, such a textile material 67 can be oriented as to exhibit greatest elongation along the vertical or z axis on the front or anterior side 44, and orientated as to exhibit greatest elongation along the horizontal or x axis on the back or posterior side 45.

FIG. 4 is a front or anterior view of alternate preferred underwear 21.3 in position on a male wearer 20, and including superior retention means 41 and a superior edge 50 on anterior side 44 forming a straight, that is, a horizontal waistline 52. Also shown is a line indicating the middle 49 of the wearer's 20 torso 43.

FIG. 5 is a side view of the alternate preferred underwear 21.3 shown in FIG. 4 including superior retention means 41 and a superior edge 50 on anterior side 44 forming a straight, that is, a horizontal waistline 52.

Figure 6:
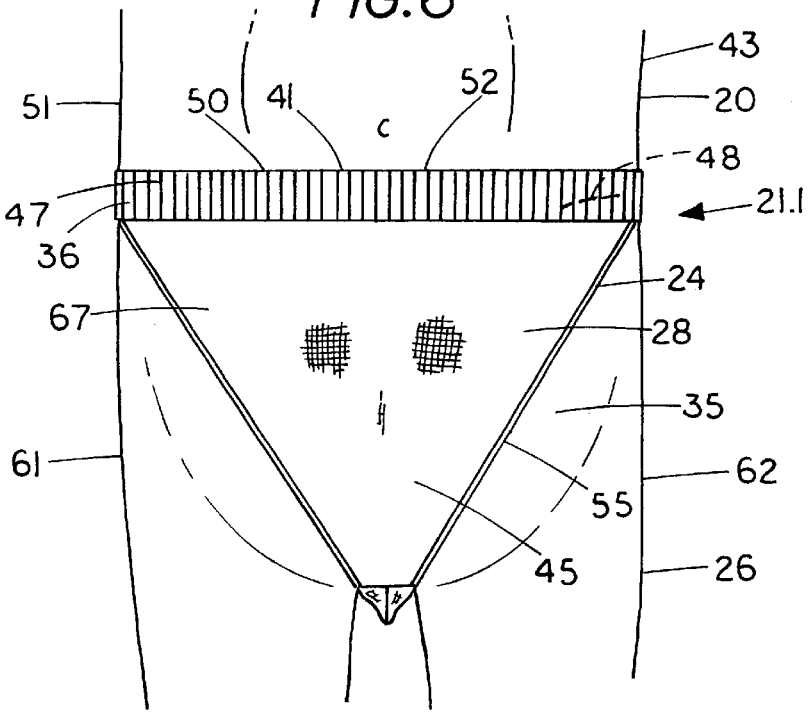
FIG. 6 is a posterior view of the underwear of the invention, and a male wearer.

FIG. 6 is a back or posterior 45 view of the preferred underwear 21.1 shown in FIG. 1. The superior edge 50 of the outer layer 22 on the back or posterior 45 side of the underwear 21.1 can consist of a conventional horizontal waistline 52. It can be advantageous that the underwear 21.1 be designed so that the superior edge 50 of the retention means 36 is proximate and slightly superior with respect to the iliac crests 48 of the hips about a wearer's 20 sides 51 in order to help retain the underwear 21.1 in optimal position upon the wearer 20.

Figure 7:
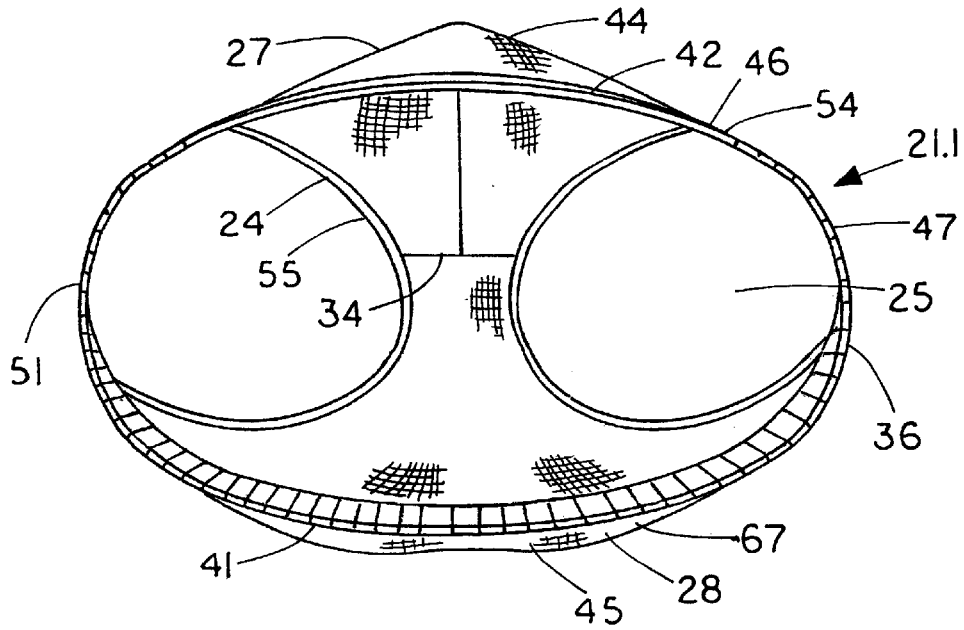
FIG. 7 is a top view of the underwear of the invention for a male wearer.
Figure 8:
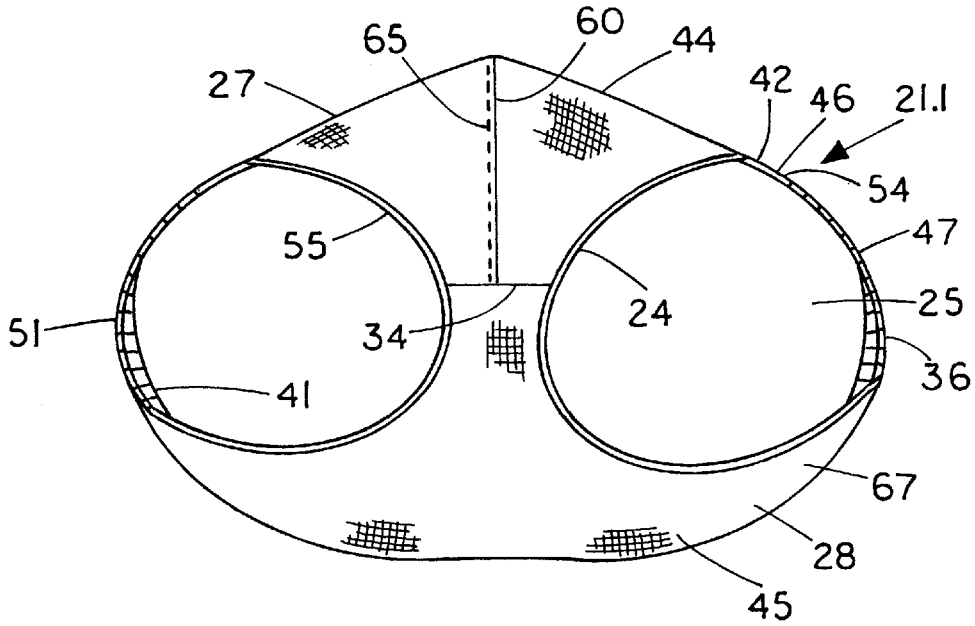
FIG. 8 is a bottom view of the underwear of the invention for a male wearer.

FIG. 7 is a top view of the preferred underwear 21.1 shown in FIG. 1 for a male wearer 20. It can be seen that the inferior retention means 42 on the anterior side 44 substantially consists of a substantially non-stretchlastic material 46, such as belting 54, and in particular in the area which would correspond to the wearer's abdomen 39 in the area between the anteriormost aspects of the wearer's opposing iliac crests 48. FIG. 8 is a bottom view of the underwear 21.1 shown in FIG. 1 for a male wearer.

Figure 10:
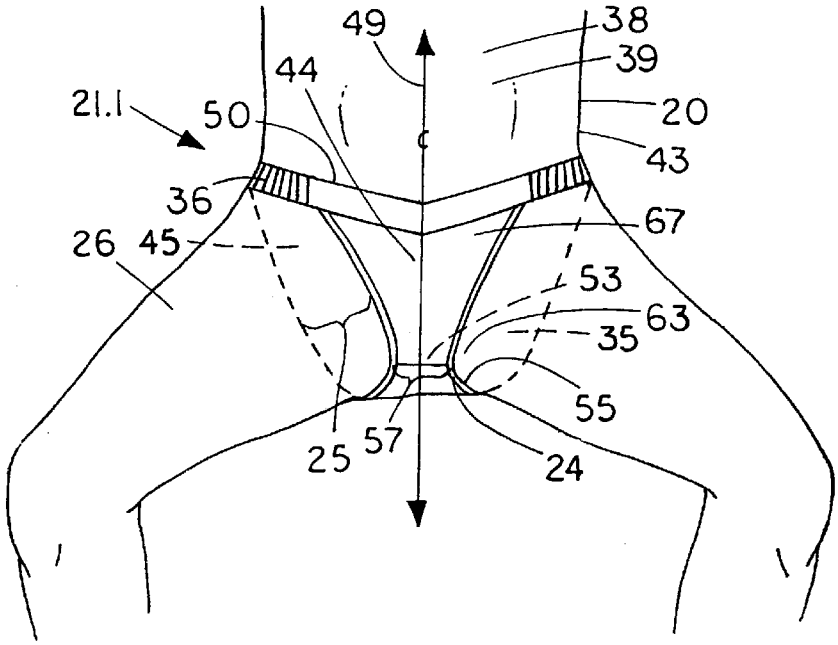
FIG. 10 is a bottom perspective view of the underwear of the invention in position on a male wearer showing the point of minimum width between the two openings for the wearer's legs.

As shown in FIG. 10, it can be advantageous that the underwear 21.1 be made in a preferred range in width where it passes between a wearer's 20 legs 26 and attains its narrowest dimension or minimum width 57. On one hand, if the minimum width 57 is too narrow in this area, then the underwear 21.1 can ride up in thong like fashion between the cheeks of a wearer's 20 buttocks 35 causing chafing and discomfort. On the other hand, if the minimum width 57 is too wide in this area, the direction of pull of the elastic material 24 and/or stretchlastic material can be such as to bias the underwear 21.1 against the inner or medial side 63 of the wearer's 20 legs 26 causing chafing and discomfort. For an individual who wears size medium underwear 21.1, e.g., an individual having a 34 inch waist, the preferred range of the minimum width 57 in the area between a wearer's 20 legs 26 is between one and one and three quarters inches.

Figure 11:
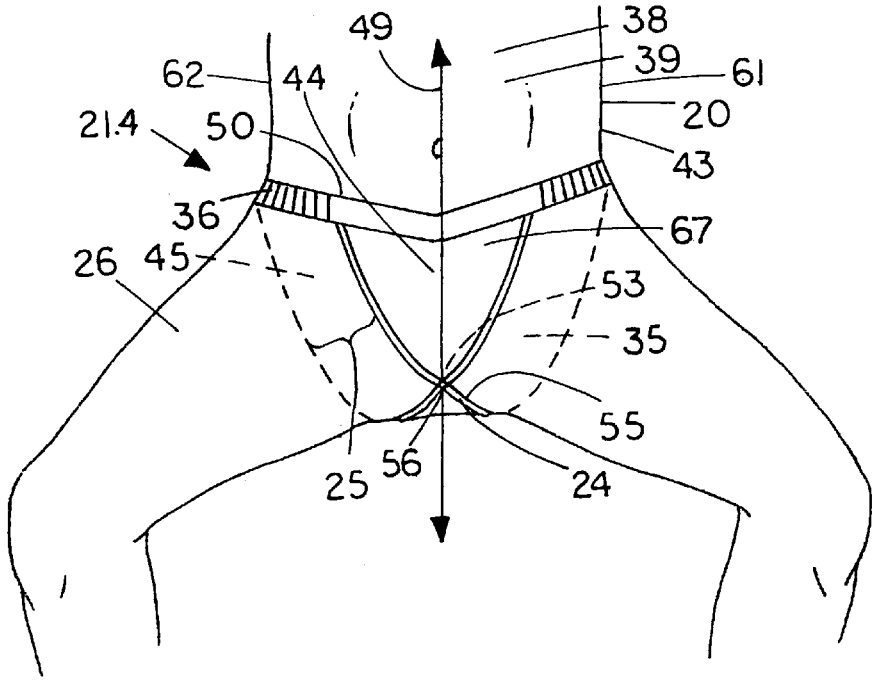
FIG. 11 is a bottom perspective view of the underwear of the invention in position on a male wearer having elastic material configured in an X shape.

As shown in FIG. 11, it is possible for the elastic material 24 to cross from the opposite sides of the torso from right 62 to left 61 and left 61 to right 62 between the anterior side 44 and posterior side 45 of the underwear 21.4 to form an X shaped configuration 56. This configuration is not preferred relative to underwear 21.1 shown in FIG. 10 due to the tendency for underwear 21.4 shown in FIG. 11 to climb up between the buttocks 35 which can cause chafing.

Figure 12:
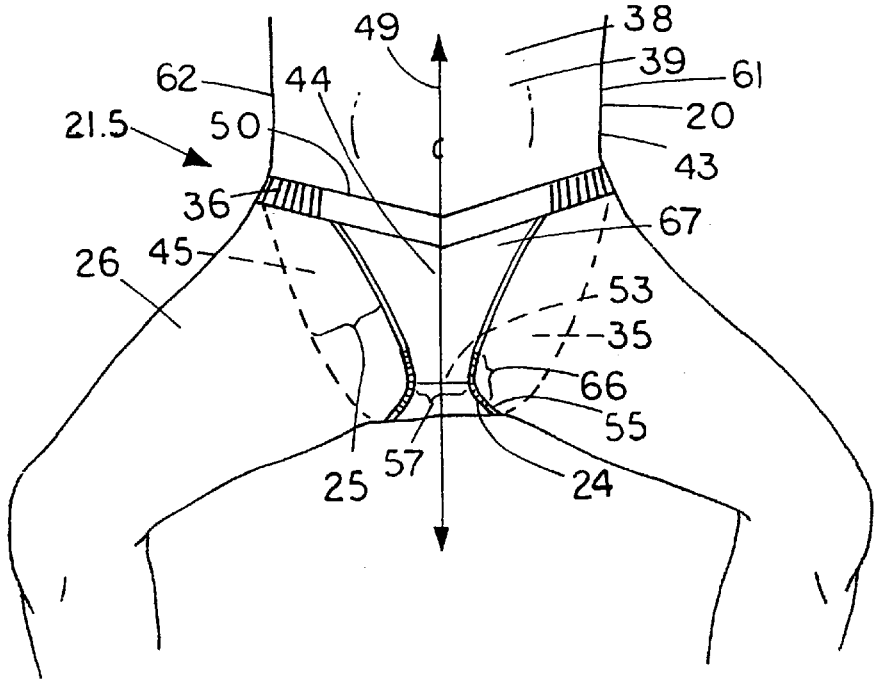
FIG. 12 is a bottom perspective view of the underwear of the invention having an area of differential elastic and stitching near the point of minimum width.

FIG. 12 is a bottom view of alternate preferred underwear 21.5 in position on a male wearer 20. Underwear 21.5 are generally similar in configuration to underwear 21.1 shown in FIG. 1. However, it can be advantageous to use an area of differential elastic and stitching 66 near the point of minimum width 57. Accordingly, in a medium sized pair of underwear 21.5, it can be advantageous that near the edge 55 of openings 25 for a wearer's 20 legs 26 that between one and three inches in length on either side of the location associated with the point of minimum width 57 of the underwear 21.5 consist of an area of differential elastic and stitching 66. It can be advantageous that a stitching pattern characterized by relatively low surface roughness there be used, and that the configuration of the elastic material 24 and one or more textile material 67 used to make underwear 21.5, as affixed by stitching 65, have a low profile and relatively smooth edges. Further, when the elastic material 24 and textile material 67 are affixed together by stitching 65, it can be advantageous that the elastic material 24 not be elongated, or alternately, not be greatly elongated in the desired area of differential elastic and stitching 66, as this can cause bunching of the underwear 21.5 which can then result in chafing during use.

Figure 13:
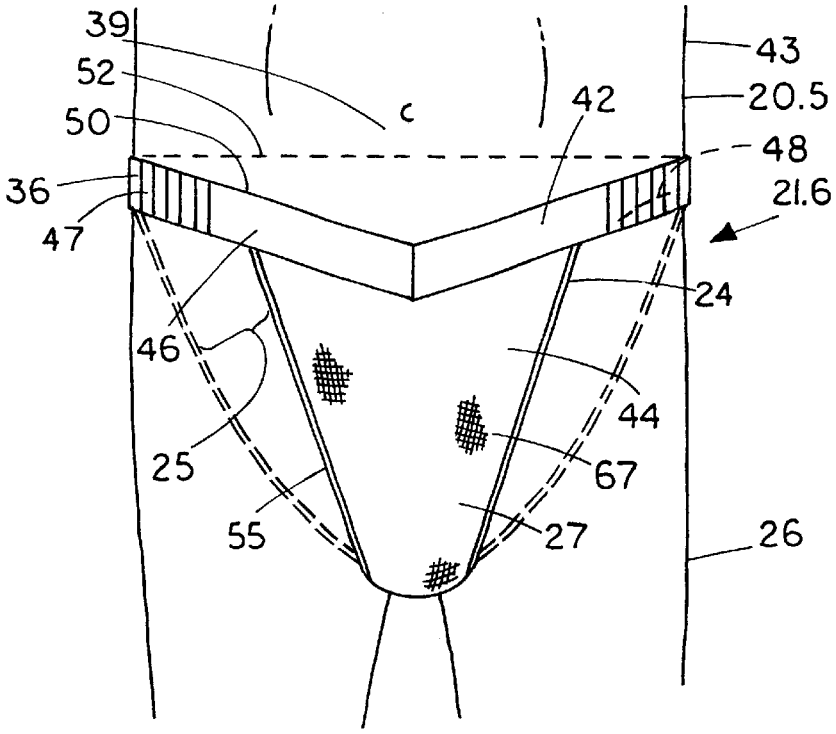
FIG. 13 is an anterior view of alternate underwear of the invention having a V shape, and a female wearer.

FIG. 13 is an anterior view of alternate underwear 21.6 of the invention having a V shape, and a female wearer 20.5. In embodiments of preferred underwear for women, the textile material 67 used to form the anterior side 44 of the underwear 21.6 is not folded along the middle 49 and affixed at an inferior edge 60 by stitches 65, as with the men's underwear 21.1 shown in FIG. 1.

Figure 14:
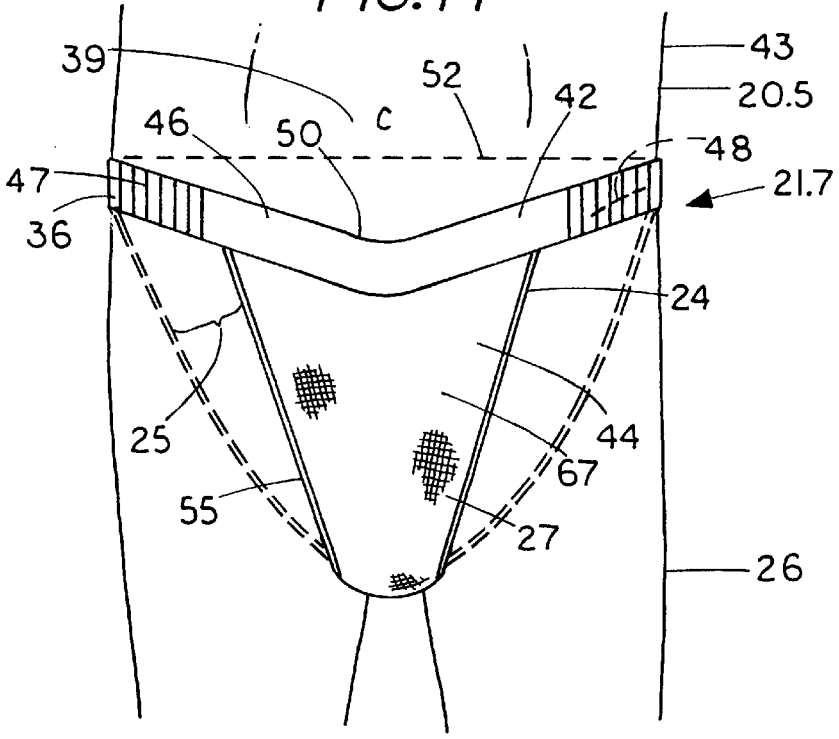
FIG. 14 is an anterior view of an alternate embodiment of the underwear of the invention having a U shape, and a female wearer.

FIG. 14 is an anterior view of an alternate underwear 21.7 of the invention having a U shape, and a female wearer 20.5.

Figure 15:
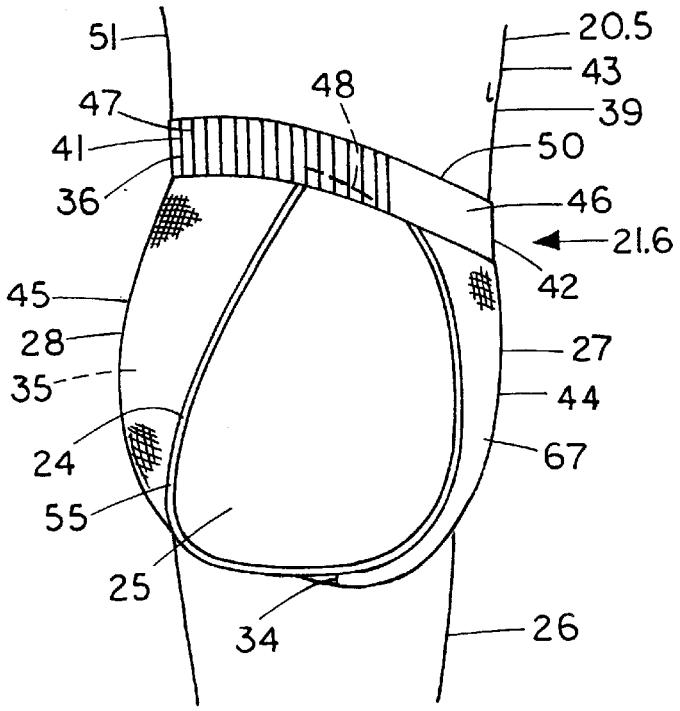
FIG. 15 is a side view of the underwear of the invention shown in FIG. 13 having a V shape, and a female wearer.

FIG. 15 is a side view of the underwear 21.6 of the invention having a V shape shown in FIG. 13, and a female wearer 20.5.

Figure 16:
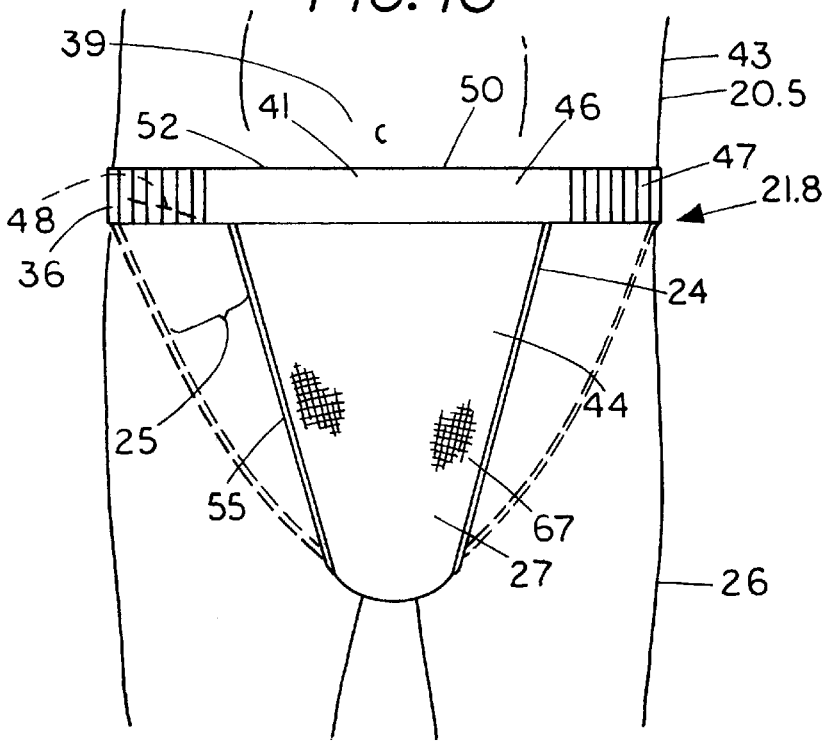
FIG. 16 is an anterior view of alternate underwear of the invention having a straight, that is, horizontal waistline, and a female wearer.

FIG. 16 is an anterior view of an alternate underwear 21.8 of the invention having a straight, that is, a horizontal waistline 52, and a female wearer 20.5.

Figure 17:
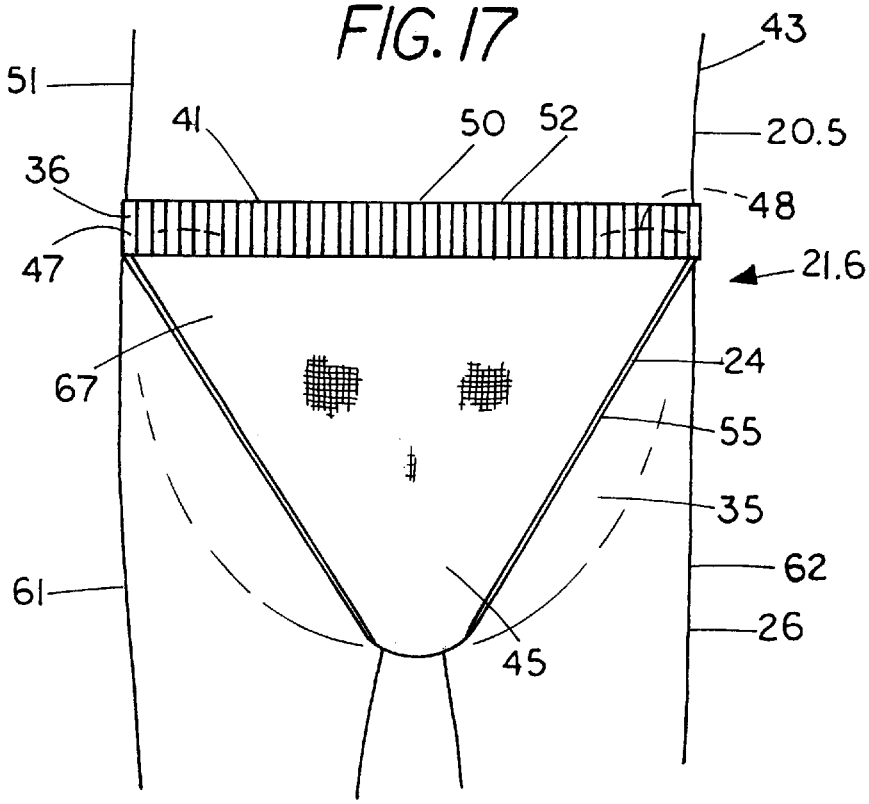
FIG. 17 is a posterior view of the underwear of the invention shown in FIG. 13, and a female wearer.

FIG. 17 is a posterior view of the underwear 21.6 of the invention shown in FIG. 13, and a female wearer 20.5.

Figure 18:
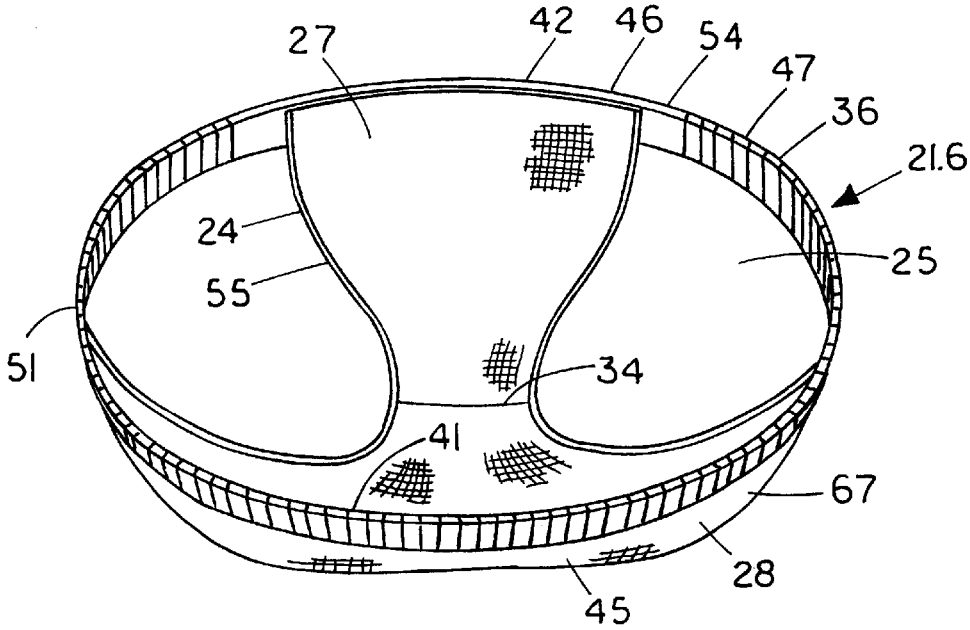
FIG. 18 is a top view of the underwear of the invention shown in FIG. 13 for a female wearer.

FIG. 18 is a top view of the underwear 21.6 of the invention shown in FIG. 13, for a female wearer.

Figure 19:
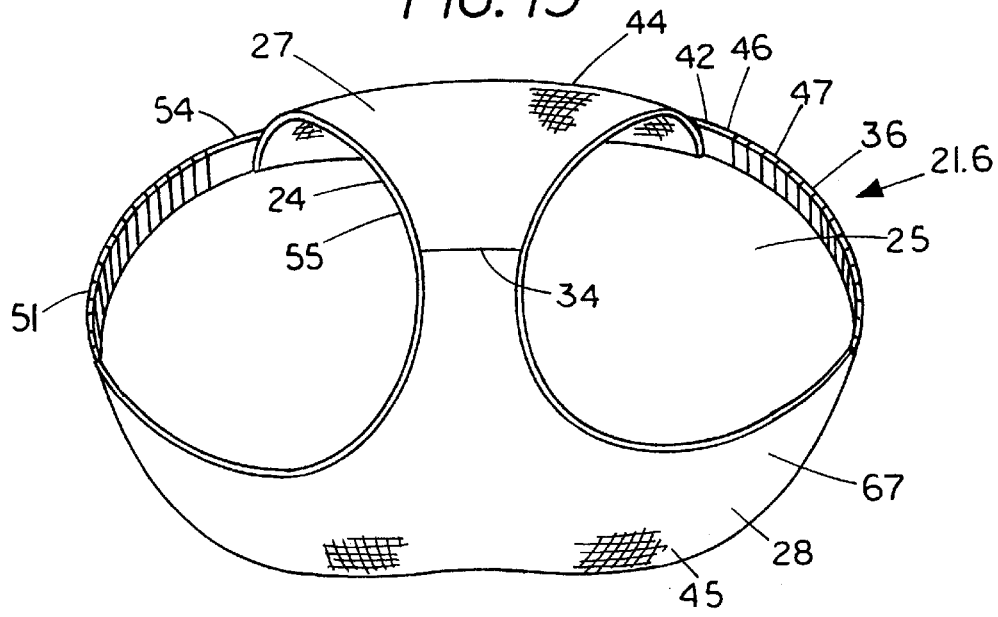
FIG. 19 is a bottom view of the underwear of the invention shown in FIG. 13 for a female wearer.

FIG. 19 is a bottom view of the underwear 21.6 of the invention shown in FIG. 13, for a female wearer.

Figure 20:
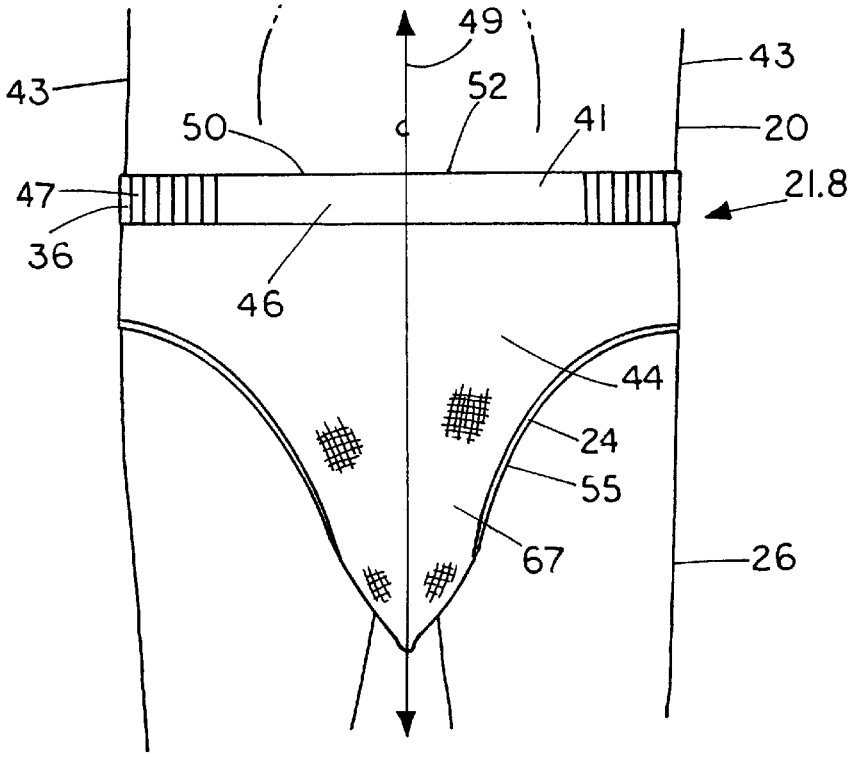
FIG. 20 is an anterior view of alternate underwear of the invention having a horizontal waistline, and openings which encompass a wearer's legs, and a male wearer.

FIG. 20 is an anterior view of alternate underwear 21.8 of the invention having a horizontal waistline, and a male wearer 20. The underwear 21.8 include retention means 36 consisting of superior retention means 41 and a horizontal waistline 52. However, the retention means 36 used on the front or anterior side 44 of the underwear 21.8 substantially consists of a non-stretchlastic material 46 such as belting 54, and the like, which does not in and of itself place a spring preload upon the abdomen 39 of a wearer 20. The underwear 21.8 has openings 25 which encompass a wearer's 20 legs 26, whereas the underwear 21.1 shown in FIG. 1 has larger openings 25 which only partially encompass a wearer's legs 26.

Figure 21:
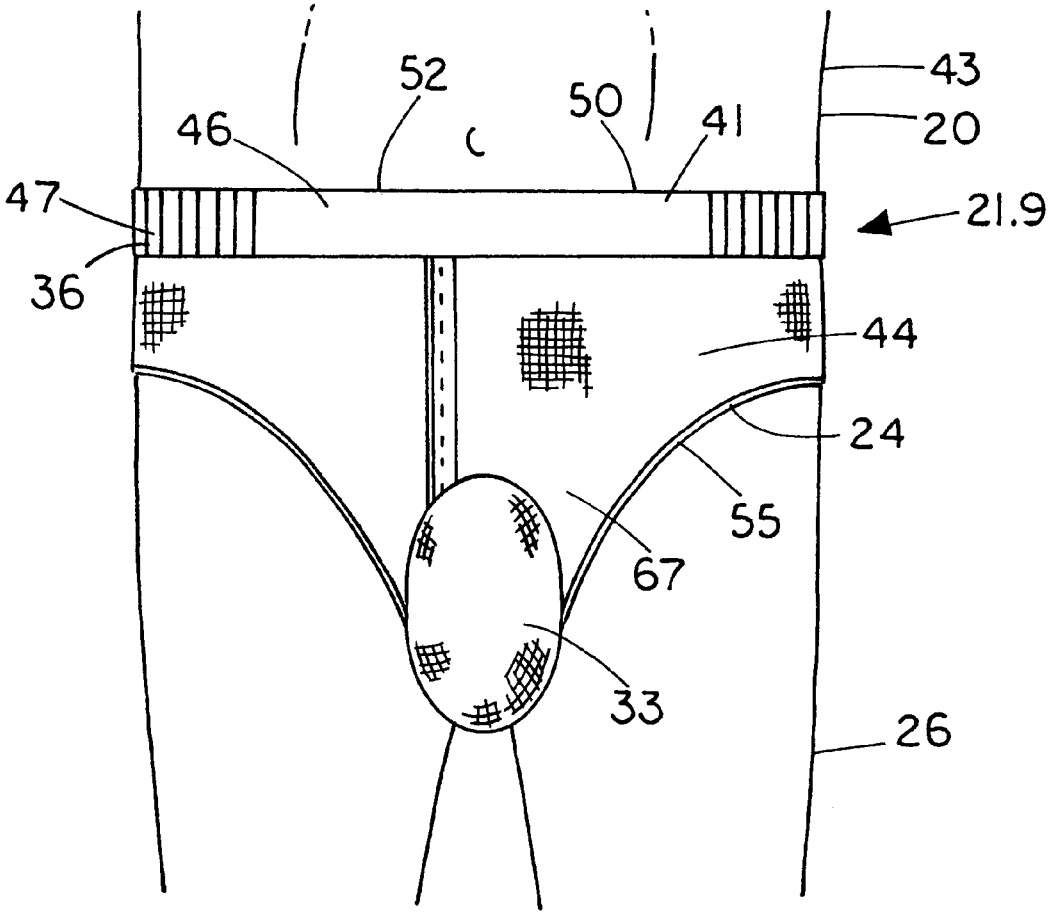
FIG. 21 is an anterior view of alternate underwear of the invention having a horizontal waistline, openings which encompass a wearer's legs, an appendage, and a male wearer.

FIG. 21 is an anterior view of alternate underwear 21.9 of the invention having a horizontal waistline 52, and a male wearer 20. The underwear 21.9 has openings 25 which encompass the wearers 20 legs 26, and a conventional structure on the anterior side 44 such as an appendage 33 for containing, elevating and supporting the male reproductive organs against the pubic area 53 of the torso 43. However, the alternate underwear 21.9 includes superior retention means 41 on the anterior side 44 substantially consisting of a non-stretchlastic material 46 such as belting 54 which does not in and of itself place a spring preload upon the abdomen 39 of a wearer 20.

The underwear taught in the present invention can be advantageous for casual, recreational, or athletic use. It can be readily understood that underwear having a superior edge forming a U or V shape, and inferior retention means on the anterior side as taught in the present invention, can be used in combination with other conventional underwear constructions. Likewise, the preferred construction of the anterior side of men's underwear, that is, taking a single piece of textile material and folding it along the middle and stitching it at the inferior edge, can be used in combination with underwear having a conventional waistband. Further, it can be readily understood that female wearers can derive benefit from underwear having an anterior side having a superior edge forming a U or V shape, inferior retention means substantially consisting of a non-stretchlastic material, a preferred range in minimum width in the area between the openings for a wearer's legs, and an area of differential elastic and stitching near the location of minimum width. Moreover, it can be readily understood that the individual features and characteristics disclosed herein in various embodiments of underwear can be combined in partial, or complete combination.

While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

Although the present invention has been described with reference to preferred embodiments, workers skilled in the art will recognize that changes may be made in form and detail without departing from the spirit and scope of the invention.

What is claimed is:

1. Underwear for use by a wearer having an abdomen, torso, legs, and opposing iliac crests each having an anteriormost portion, said underwear comprising an anterior side having a middle, a posterior side, a left side, a right side, a superior edge, a textile material, two openings for accommodating said legs of said wearer, and retention means, said retention means substantially comprising a substantially non-elastic material on said anterior side, said retention means substantially comprising a substantially elastic material on at least, said left side, and said right side, said non-elastic material extending substantially across said wearer's abdomen between the anteriormost portion of each of said wearer's opposing iliac crests, said anterior side substantially comprising inferior retention means, the superior edge of said anterior side comprising a V-shape.

2. The underwear according to claim 1, comprising a substantially horizontal superior edge on said posterior side, wherein the superior edge in the middle of said anterior side is inferior to the superior edge of said posterior side in the range between one and four inches.

3. The underwear according to claim 1, wherein said non-elastic material comprises belting.

4. The underwear according to claim 1, further comprising elastic material bordering said two openings.

5. The underwear according to claim 1, said underwear comprising a minimum width between said two openings, said minimum width comprising the range between one and one and three quarters inches.

6. The underwear according to claim 5, further comprising differential elastic and stitching near the location of said minimum width.

7. The underwear according to claim 1, said textile material substantially located inferior of said retention means and further comprising a first textile material and a second textile material, and said first textile material used on said anterior side comprises greater elongation along the vertical axis relative to the horizontal axis, whereas said second textile material used on said posterior side comprises greater elongation along the horizontal axis relative to the vertical axis.

8. The underwear according to claim 1, said textile material substantially located inferior of said retention means and comprising different elongation characteristics in two directions, said textile material orientated as to comprise greater elongation along the vertical axis relative to the horizontal axis on said anterior side, and said textile material orientated as to comprise greater elongation along the horizontal axis relative to the vertical axis on said posterior side.

9. The underwear according to claim 1, comprising a configuration for permitting the male reproductive organs to be substantially suspended naturally along the vertical axis while substantially restraining anterior and side to side movement of said male reproductive organs.

10. The underwear according to claim 1, substantially comprising on said anterior side a single piece of said textile material substantially located inferior of said retention means and further comprising an inferior edge, said textile material being folded along said middle and stitched at said inferior edge.

11. The underwear according to claim 1, comprising an appendage.

12. Underwear for use by a male wearer having an abdomen, torso, legs, reproductive organs, and opposing iliac crests each having an anteriormost portion, said underwear comprising an anterior side having a middle, a posterior side, a left side, a right side, a superior edge, a textile material, two openings for accommodating said legs of said wearer, and retention means, said retention means substantially comprising a substantially non-elastic material on said anterior side, said retention means substantially comprising a substantially elastic material on at least said left side and said right side, said non-elastic material extending substantially across said wearer's abdomen between the anteriormost portion of each of said wearer's opposing iliac crests, said anterior side substantially comprising inferior retention means, the superior edge of said anterior side comprising a V-shape, said underwear configured for permitting said male reproductive organs to be substantially suspended naturally along the vertical axis while substantially restraining anterior and side to side movement of said male reproductive organs.

13. Underwear for use by a wearer having an abdomen, torso, legs, and opposing iliac crests each having an anteriormost portion, said underwear comprising an anterior side having a middle, a posterior side, a left side, a right side, a superior edge, a textile material, two openings for accommodating said legs of said wearer, and retention means, said retention means substantially comprising a substantially non-elastic material on said anterior side, said retention means substantially comprising a substantially elastic material on at least said left side and said right side, said non-elastic material extending substantially across said wearer's abdomen between the anteriormost portion of each of said wearer's opposing iliac crests, said anterior side substantially comprising inferior retention means, the superior edge of said anterior side comprising a U-shape.

14. The underwear according to claim 13, comprising a substantially horizontal superior edge on said posterior side, wherein the superior edge in the middle of said anterior side is inferior to the superior edge of said posterior side in the range between one and four inches.

15. The underwear according to claim 13, further comprising elastic material bordering said two openings.

16. The underwear according to claim 13, said underwear comprising a minimum width between said two openings, said minimum width comprising the range between one and one and three quarters inches.

17. The underwear according to claim 13, said textile material substantially located inferior of said retention means and further comprising a first textile material and a second textile material, and said first textile material used on said anterior side comprises greater elongation along the vertical axis relative to the horizontal axis, whereas said second textile material used on said posterior side comprises greater elongation along the horizontal axis relative to the vertical axis.

18. The underwear according to claim 13, said textile material substantially located inferior of said retention means and comprising different elongation characteristics in two directions, said textile material orientated as to comprise greater elongation along the vertical axis relative to the horizontal axis on said anterior side, and said textile material orientated as to comprise greater elongation along the horizontal axis relative to the vertical axis on said posterior side.

19. The underwear according to claim 13, comprising a configuration for permitting the male reproductive organs to be substantially suspended naturally along the vertical axis while substantially restraining anterior and side to side movement of said male reproductive organs.

20. The underwear according to claim 13, substantially comprising on said anterior side a single piece of said textile material substantially located inferior of said retention means and further comprising an inferior edge, said textile material being folded along said middle and stitched at said inferior edge.

21. The underwear according to claim 13, comprising an appendage.

* * * * *